US005232172A

United States Patent [19]

Nash

[11] Patent Number: 5,232,172

[45] Date of Patent: Aug. 3, 1993

[54] WEB CONVEYING APPARATUS

[75] Inventor: Victor W. Nash, Richmond, Va.

[73] Assignee: Molins Machine Company, Inc.

[21] Appl. No.: 777,196

[22] Filed: Oct. 16, 1991

[30] Foreign Application Priority Data

Oct. 16, 1990 [GB] United Kingdom ..... 9022404

[51] Int. Cl.[5] ..... B65H 16/00

[52] U.S. Cl. ..... 242/55

[58] Field of Search ..... 242/55, 58.1, 58.2, 242/58.3, 58.4, 58, 57, 54 R, 1, 128, 36, 37 R, 47, 49, 67.1 R

[56] References Cited

U.S. PATENT DOCUMENTS 4,848,691 7/1989 Muto et al. ..... 242/58.1

4,967,974 11/1990 Kawamura ..... 242/58.1 X R 4,984,750 1/1991 Shigeta et al. ..... 242/58.1

*Primary Examiner*—Stanley N. Gilreath

*Attorney, Agent, or Firm*—Antonellli, Terry, Stout & Kraus

[57] ABSTRACT

A bobbin holder (1), particularly for a cigarette making machine, is provided with a device for rewinding the expiring end of a reel (2) back on to the reel core (6) following a splice. This provides a convenient way of removing the expired end (with the core) and avoids possible entanglement of a loose expired end in parts of the machine. The device may comprise a pin (22) carried by a rotatable support (12) for the reel (2) and axially slidable by engagement with a cam (24) into a position to intercept the expiring end following a splice, so that continued rotation of the support causes the end to be wrapped around the reel core.

12 Claims, 6 Drawing Sheets

WEB CONVEYING APPARATUS

Figure 1:
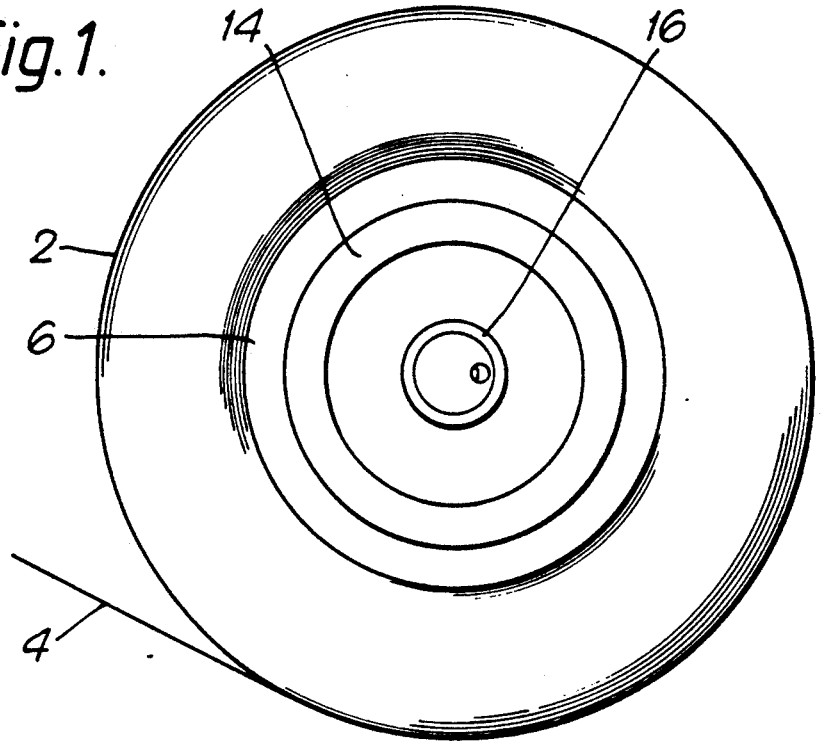

In cigarette making machines wrapper for enveloping a tobacco rod is generally fed from a bobbin carrying a reel of wrapper web. Usually the machine has two bobbin holders, the arrangement being such that the machine may be fed from bobbins on either holder, there being a splicing unit for joining the trailing end of the web from an expiring bobbin to the leading end of a web from a fresh bobbin. In this way the machine may be continuously supplied with wrapper web without the need for interruption of production.

Although clearly it is desirable to use up as much of an expiring web as possible, for various reasons it is not generally possible to form a splice at the end of the web on a bobbin, so that at the moment of each splice there is usually a small amount of web remaining on the expiring bobbin (and between the bobbin and the splicing unit). This expiring end of the web is severed by the splicing unit. Due to continued rotation of the expiring bobbin it can happen that the expiring end of the web becomes completely unwound from the core of the bobbin shortly after a splice, with the result that the loose length of wrapper web thereby released becomes entangled in part of the machine causing possible malfunction and/or damage. At the very least it is likely to require operator intervention to remove it.

Some bobbin holders are provided with braking means which reacts to change in wrapper web tension and which would usually come into operation to reduce the rotational speed of the bobbin holder following a splice. This is not a complete answer to the problem, however, since when there is a relatively short length of wrapper web left on a bobbin the brake may not reduce the speed of the bobbin quickly enough to prevent detachment of the expiring end of the web and, in any event, the loose length of the wrapper web between the expiring bobbin and the splicing unit still remains.

It is an object of the invention to alleviate the problem of handling the expiring end of the web on a bobbin.

According to the invention web conveying apparatus includes a rotatable support for a reel of the web, guide means defining a path for the web unwound from the reel, and operable means rotatable with the support for engaging the web between the reel and the guide means, preferably when the reel is almost completely unwound, and for causing web to be rewound around the heel on further rotation of the support.

Preferably the operable means is carried on the support at a position corresponding to the diameter of a reel which has been substantially unwound. Preferably the operable means comprises means movable between a retracted position not in the path of the web and an operative position at least partly intercepting the web path on rotation of the support. The operable means is preferably operable by actuating means which is initiated by or subsequent to severing (including breakage) of the web, particularly at a splicing unit beyond the guide means.

In a preferred arrangement the operable means comprises a pin slidable in a block carried by a bobbin holder. The pin may be movable between a retracted position and an operative position, in which one end of the pin is extended into the web path, by means of a cam surface which is movable into the path of the other end of the pin. In operation, after the cam is moved (e.g. by a piston and cylinder unit) the other end of the pin engages the cam surface during the next revolution of the bobbin holder and is thereby moved into its extended position. During the next revolution the pin, in its extended position, engages part of the web and starts to wrap it around the bobbin. Subsequent rotation of the support causes the pin to form a loop in the web and wrap it around the bobbin thereby dragging any remaining loose part of the web backwards past the guide means and causing it to be wrapped around the bobbin. When the bobbin comes to rest, e.g. after operation of brake means, the bobbin may be discarded, with the loose end of the web wrapped around it. Placement of the new bobbin on the bobbin holder pushes the pin back into its retracted position.

It will be understood that the apparatus is not limited to use with cigarette making machines and may be employed elsewhere where it is desired to rewind part of a web onto a reel.

Figure 2:
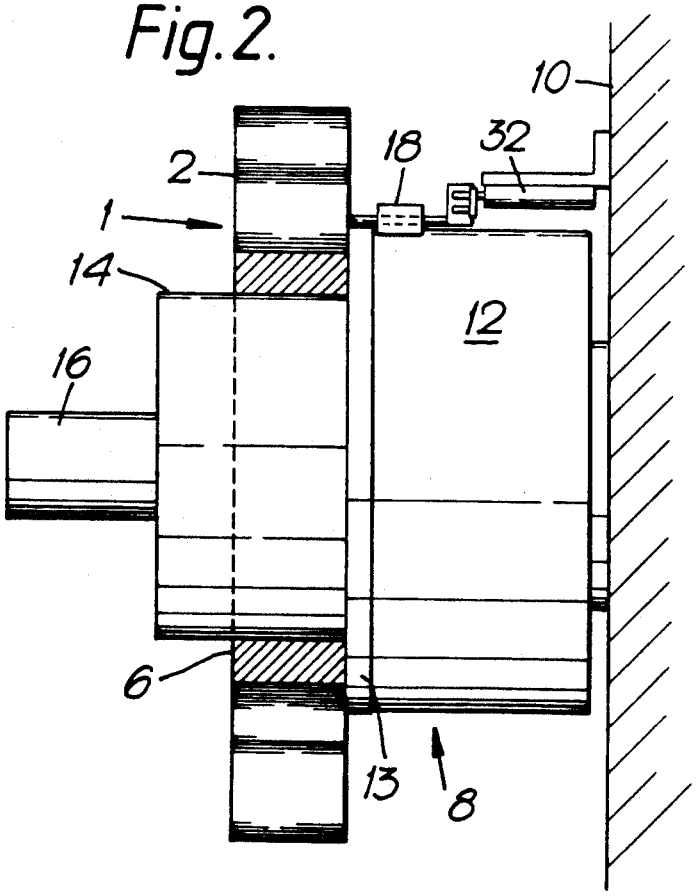
Figure 3:
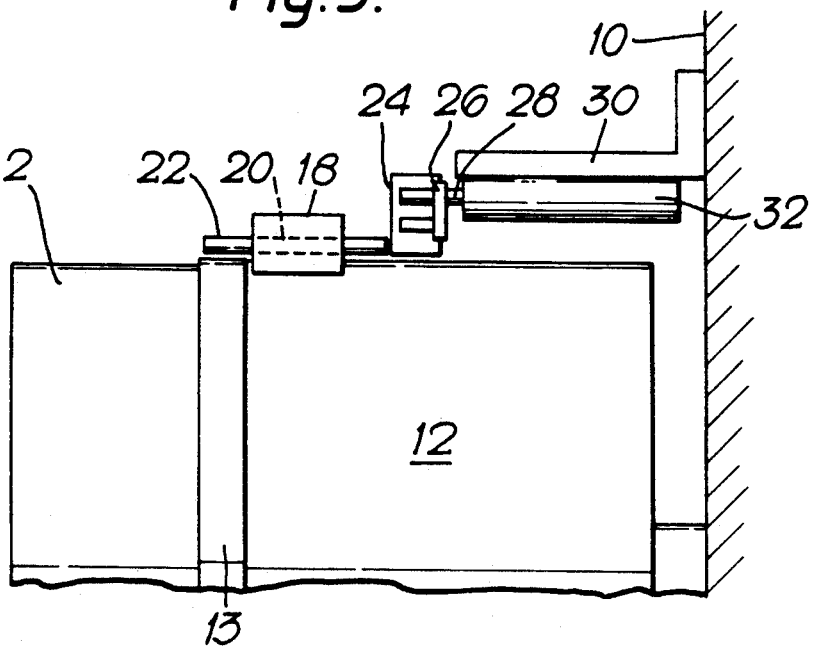
Figure 4:
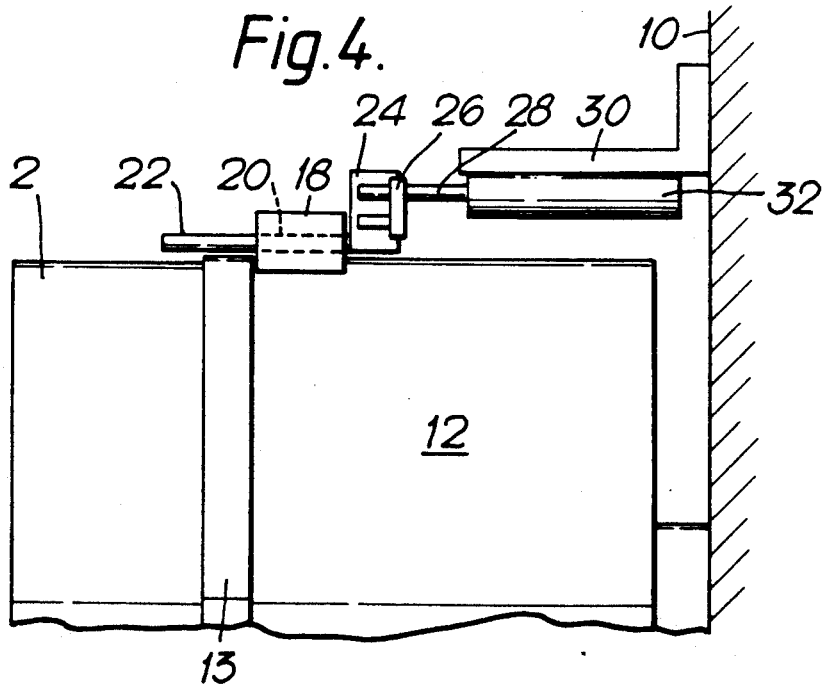

The invention will be further described, by way of example only, with reference to the accompanying diagrammatic drawings, in which:

FIG. 1 is a front view of a bobbin holder for a cigarette making machine,

FIG. 2 is a part-sectional view of the bobbin holder of FIG. 1 showing a reel end collection device incorporated in the bobbin holder, FIGS. 3 and 4 are enlarged side views of part of the bobbin holder of FIGS. 1 and 2 showing the collection device in different operative positions, and FIGS. 5–8 are front views of the bobbin holder of FIGS. 1 and 2 and associated mechanism in different stages of operation of the collection device.

FIGS. 1 and 2 show a bobbin holder 1 of a cigarette making machine in which a bobbin comprising a reel 2 of cigarette paper wrapper web 4 supported on a core 6 is mounted on a rotatable support unit 8 carried by a structural part 10 of the machine. The rotatable support 8 includes a cylindrical housing 12 having a front plate 13 and a smaller diameter hub 14 extending outwardly from it. The bobbin is carried on the hub 14 and clamped against the front plate 13 by a locking assembly 16, details of which are not shown in the drawing but which are conventional and well known in the art.

As shown in more detail in FIGS. 3 and 4, the housing 12 carries a block 18 in which is formed a throughbore 20. A pin 22 is a sliding frictional fit in the bore 20. Adjacent to the path of the block 18, as it rotates with the housing 12, is a tapered arcuate cam 24 (see also FIG. 5) which is carried by a plate 26 connected to a piston rod 28 of a piston and cylinder unit 32. A bracket 30, connected to the structural part 10 of the machine, supports the piston and cylinder unit 32.

Figure 5:
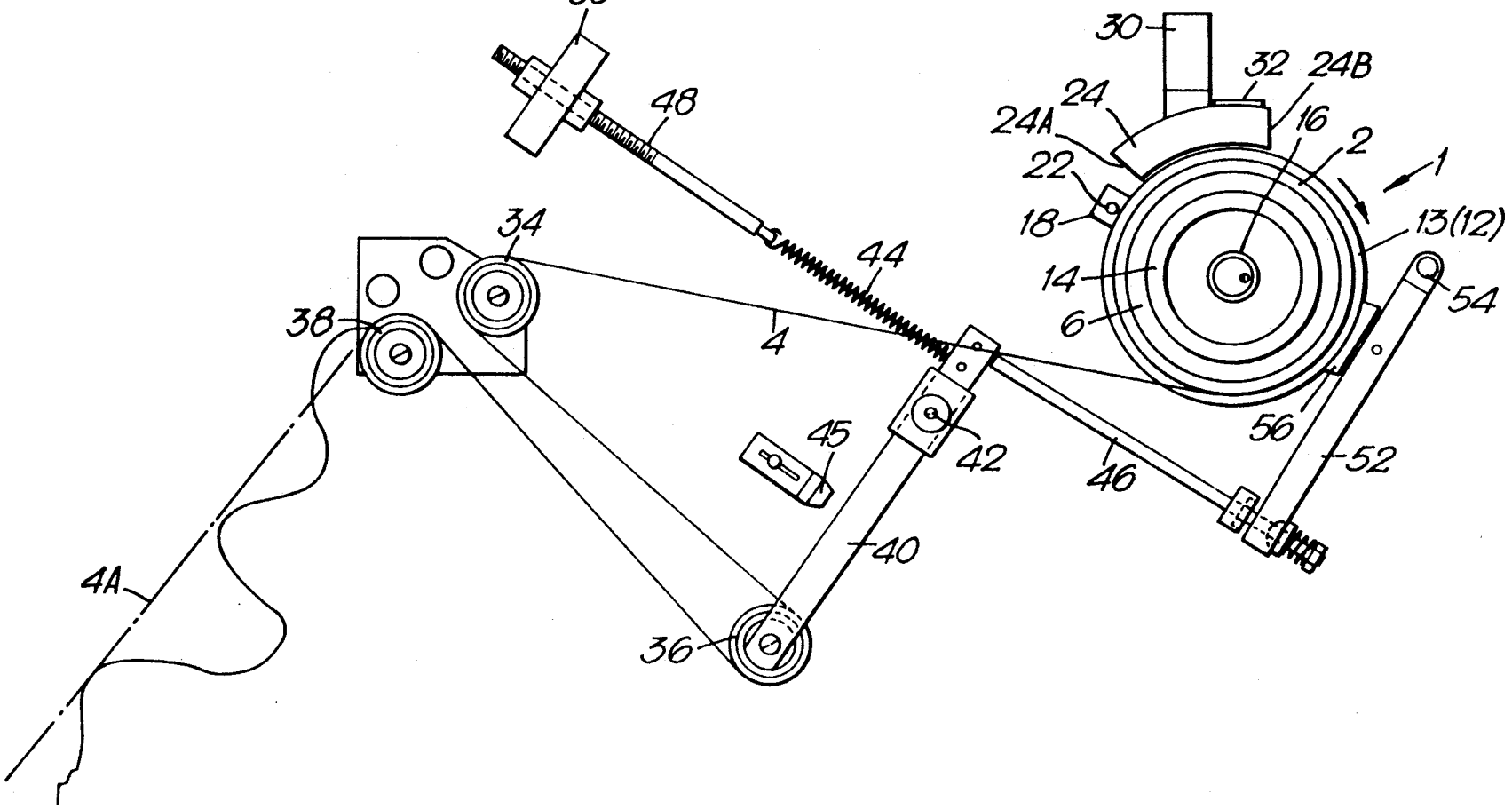
Figure 6:
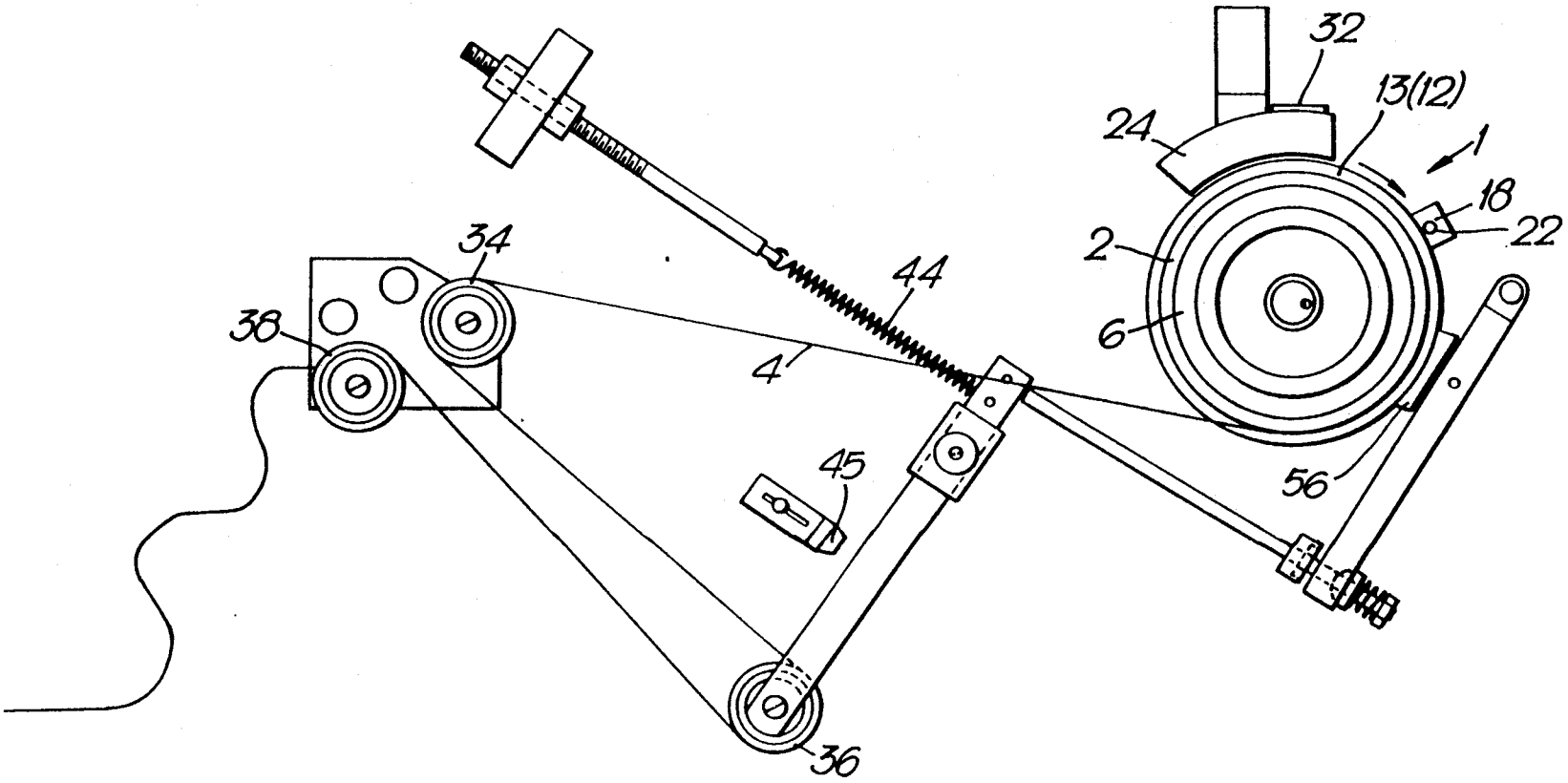
Figure 7:
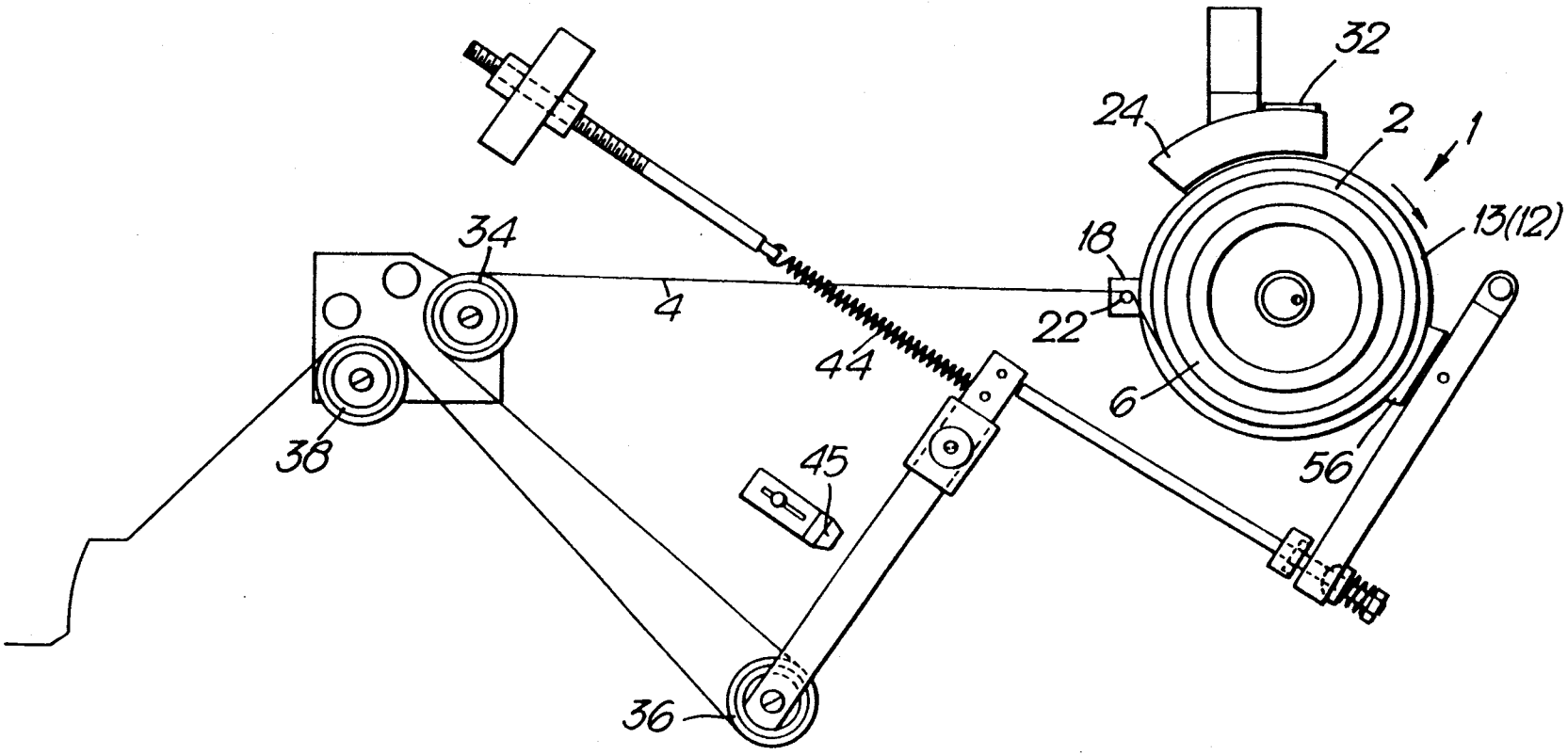
Figure 8:
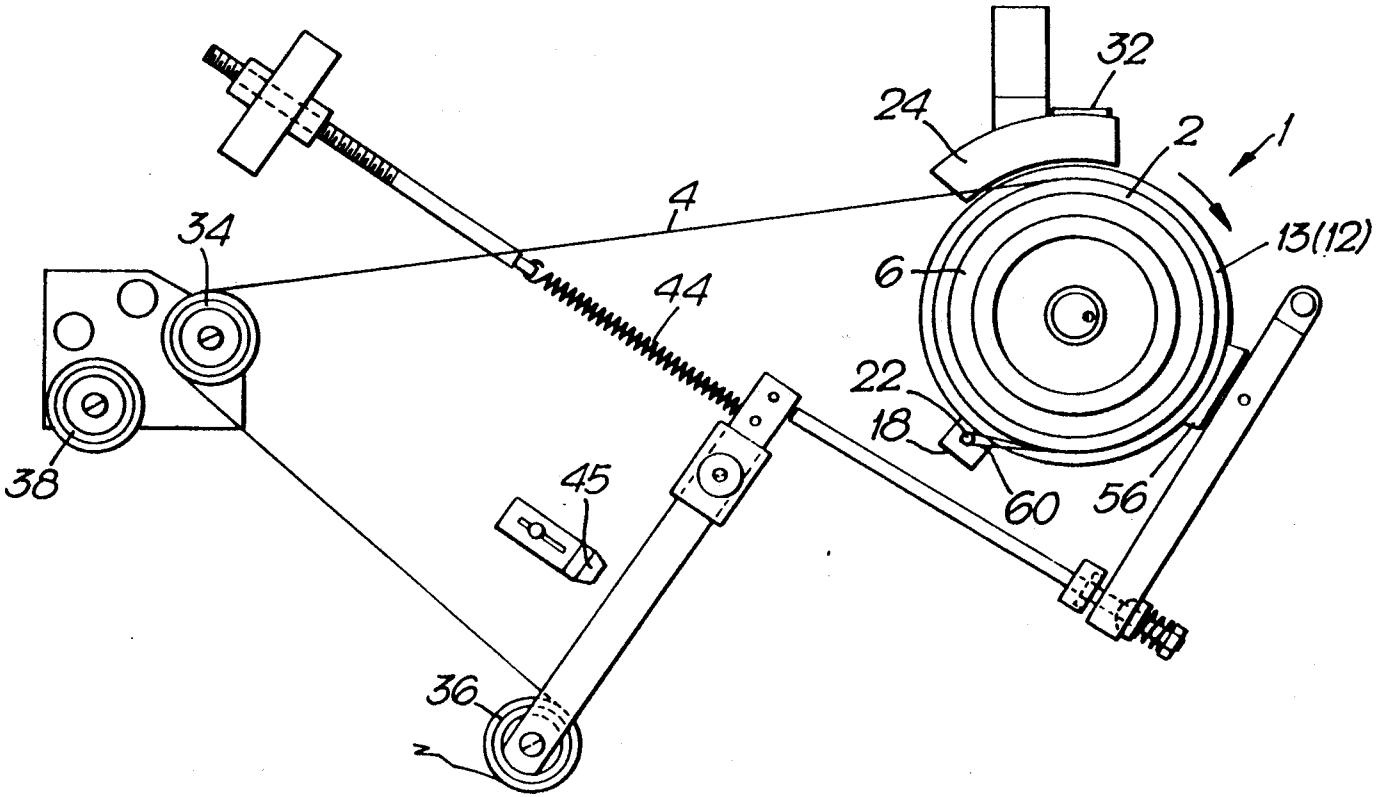

Referring now to FIG. 5, the bobbin holder 1 is arranged so that in use the web 4 is delivered around pulleys 34,36 and 38 towards and normally through a splicing unit (not shown). The normal path of the web 4 from the pulley 38 to the splicing unit is shown dotted at 4A. The pulley 36 is mounted at one end of an arm 40 pivoted at 42 and connected at its other end to a tension spring 44 and a link 46. A stationary proximity detector 45 is arranged adjacent the length of the arm 40 between the pulley 36 and pivot 42. The spring 44 is connected by way of an adjustable threaded rod 48 to a bracket 50 connected to part of the machine structure. The link 46 is adjustably connected to one end of another arm 52, which is pivoted at 54 and carries a brake shoe 56 adjacent to the periphery of the cylindrical housing 12.

When the wrapper web 4 is being delivered from the bobbin to the machine the web passes through the splicing unit following the path indicated at 4A. Tension in the web 4 passing around the pulley 36 acts through the arm 40 against tension in spring 44 and holds the brake shoe 56 clear of the housing 12 so that it can rotate freely. If tension in the web 4 reduces, usually due to a break in the web or after a splicing operation, the spring 44 causes the brake shoe 56 to be applied to the housing 12 so as to bring it to rest. The detector 45 responds to the position of arm 40 to signal a reduction in web tension.

When the reel 2 has almost expired (e.g. as detected by a diameter sensing device, not shown) the splicing unit is brought into operation to join the expiring end of the web 4 to a new web from an adjacent bobbin holder (not shown). When the splice is complete the expiring end of the web 4 is cut at the spicing unit. Tension in the web is then lost, as indicated in FIG. 5. Although this brings into operation the brake shoe 56, as explained above, the momentum of the bobbin holder 1 is such that it does not stop rotating immediately. Consequently, the expiring end of the reel 2 may become totally unwound and become entangled in parts of the machine thereby causing malfunction and/or even damage to the machine.

In order to prevent this happening in the present apparatus the piston and cylinder unit 32 is operated when or soon after the expiring web 4 is cut at the splicing unit. The detector 45 may initiate the operation of the unit 32 after each splice. On operation of the piston and cylinder unit 32 the piston rod 28 is extended from the position shown in FIG. 3 to that shown in FIG. 4. This causes the cam 24 to be moved outwardly into the path of a part of pin 22 which extends inwards from housing 18. The cam 24 is wedge-shaped in the direction of rotation of housing 12 (i.e., referring also to FIG. 5, the face of the cam is axially more distant from the reel 2 in the region of the end 24A than it is in the region of the end 24B), so that the inner end of the pin 22 is engaged by and progressively pushed outwards through the bore 20 as the block 18 is carried past the cam 24. In FIG. 4 the pin 22 has been pushed through the bore 20 to its maximum extent by the cam 24. It will be noted that the outer end of pin 22 then extends over the reel 2, i.e. it partly overlaps the web 4.

In the position shown in FIG. 5 the piston and cylinder unit 32 has been operated and the block 18 is approaching the cam 24. The pin is still in the position shown in FIG. 3. In the position of the apparatus shown in FIG. 6 the block 18 has passed the cam 24 and pin 22 is extended, i.e. it is in the position shown in FIG. 4. In the position shown in FIG. 7 the block 18 has rotated just over half a revolution from the position shown in FIG. 6 and the pin 22 has engaged the web 4 and has dragged it upwards beginning to wrap the web partly around the small amount of web remaining in reel 2. The pin 22 thus starts to pull the cut end of the web 4 backwards over the pulleys 38, 36 and 34. In the position shown in FIG. 8, in which the block 18 has rotated about another 5/6ths of a revolution from the position shown in FIG. 7, the pin 22 has formed a loop 60 in the web 4. It will be seen that continued rotation of the block 18 with housing 12 will cause the web 4 to wrap around the reel 2 and core 6, dragging the remaining part of the web 4 backwards over pulleys 34 and 36.

Subsequently, when the housing 12 comes to rest, the locking assembly 16 is released and the core 6 and remaining web 4 in reel 2 is removed, taking with it the part of the web 4 rewound around the reel 2 by the pin 22. Since the pin 22 extends for only a part of the width of the web 4 removal of the loop 60 from the pin 22 as the core 6 and reel 2 are removed presents no difficulty.

The pin 22 remains in its outwardly extended position until a new bobbin is replaced on the bobbin holder 1. As shown in FIGS. 1 and 2, the diameter of a new reel 2 is such that when a new bobbin is placed on the bobbin holder 1 the pin 22 is automatically reset by being pushed through the bore 20 as the bobbin is located in position against the front plate 13.

I claim:

1. Web conveying apparatus comprising a rotatable support for a reel of the web, said rotatable support being rotatable in a direction to unwind web from the reel, guide means for guiding the web unwound from the reel along a predetermined path, and selectably operable means carried on said support so as to be rotatable therewith and being selectively movable from a first position spaced from said path during unwinding of a first portion of the web from the reel to a second position for engaging the web unwound from the reel for causing an unwound portion of the web to be rewound onto the reel on continued rotation of the support in the direction to unwind web from the reel.

2. Apparatus as claimed in claim 1, wherein the operable means is carried on the support at a position corresponding to the diameter of a reel which has been substantially unwound.

3. Apparatus as claimed in claim 1, wherein the operable means is movable between said first position and said second position in a direction substantially parallel to the rotational axis of said support.

4. Apparatus as claimed in claim 1, including actuating means responsive to severing of the web for operating said operable means.

5. Apparatus as claimed in claim 4, including detecting means for detecting tension in the web, said actuating means being initiated by a signal from said tension detecting means.

6. Apparatus as claimed in claim 4, including brake means for causing the support to come to rest subsequent to actuation of said operable means.

7. Apparatus as claimed in claim 1, wherein the operable means comprises a pin which is slidable in a bore in a member carried by the support.

8. Apparatus as claimed in claim 7, wherein the pin is movable between a said first position and an said second position, in which one end of the pin is extended into the web path, by means of a cam surface.

9. Apparatus as claimed in claim 8, wherein the cam surface is movable between a retracted position and an operable position in which it engages the other end of the pin.

10. Apparatus as claimed in claim 1, wherein the operable means comprises means for engaging the web so as to form a loop in the web and wrap it around the reel thereby dragging any remaining loose part of the web backwards past the guide means and causing it to be wrapped around the reel when said operable means is moved to said second position.

11. Apparatus as claimed in claim 1, wherein said operable means is located on said support at a position such that placement of a new reel on the support will cause the new reel to move the operable means from its second position into its first position.

12. Apparatus as claimed in claim 1, wherein said rotatable support is adapted to receive a reel of cigarette paper for wrapping cigarette rod in a continuous rod cigarette making machine.

* * * * *